US005235831A

United States Patent [19]

Lauria et al.

[11] Patent Number: 5,235,831

[45] Date of Patent: Aug. 17, 1993

[54] COMBINATION LOCK HAVING RESETTING FEATURE

[75] Inventors: Robert E. Lauria, P.O. Box 940819, Maitland, Fla. 32794; Randall M. Ingersoll, Kissimmee, Fla.

[73] Assignees: Robert E. Lauria; Carolyn Jean Carlson, both of Maitland, Fla.

[21] Appl. No.: 825,650

[22] Filed: Jan. 23, 1992

[51] Int. Cl.[5] ..... E05B 37/02

[52] U.S. Cl. ..... 70/312; 70/314; 70/316

[58] Field of Search ..... 70/312, 314, 315–319, 70/69–72, 74, 67

[56] References Cited

U.S. PATENT DOCUMENTS

| | | | |
|---|---|---|---|
| 2,640,344 | 6/1953 | Margo | 70/314 |
| 3,766,760 | 10/1973 | Mohrhauser et al. | 70/314 |
| 4,366,687 | 1/1983 | Atkinson | 70/71 |
| 4,520,641 | 6/1985 | Bako | 70/316 |
| 4,646,547 | 3/1987 | Scelba et al. | 70/312 |
| 4,722,208 | 2/1988 | Ye | 70/316 |
| 4,732,021 | 3/1988 | Su | 70/317 |
| 4,831,860 | 5/1989 | Sheiman et al. | 70/316 |
| 4,934,163 | 6/1990 | Sassella | 70/312 |

FOREIGN PATENT DOCUMENTS

| | | | |
|---|---|---|---|
| 2067649 | 7/1981 | United Kingdom | 70/312 |

*Primary Examiner*—Peter M. Cuomo
*Assistant Examiner*—Darnell M. Boucher
*Attorney, Agent, or Firm*—William M. Hobby, III

[57] ABSTRACT

A combination lock mechanism for briefcases allows the combination wheels to be rotated to a predetermined combination to unlock the lock and thereupon return the combination wheels back to a zero setting so that the lock combination cannot be observed by another party once the case is opened.

16 Claims, 3 Drawing Sheets

COMBINATION LOCK HAVING RESETTING FEATURE

BACKGROUND OF THE INVENTION

The present invention relates to a combination lock mechanism for briefcases, suitcases, and the like, and especially to a combination lock mechanism which will return the combination wheels to a zero position following opening of the combination lock to prevent observation of the combination when the case is opened.

In the past, there have been a variety of locking mechanisms used for briefcases, suitcases, and the like and these include combination lock mechanisms which use latching members which allow the case to be unlocked when the combination is set by rotating indicia wheels to lineup the proper indicia. Once the combination has been set on a combination lock, the combination stays in that position once the case is unlocked so that the combination for unlocking the case typically stays in that position while the case is being used or even when the case is not being used and sometimes for days at a time so that anyone desiring to know the combination can observe it after the case is opened for unlocking the case at a later time. Many combination locks for briefcases today have a provision for changing the combination by the user and typically this is done in a variety of ways including settable permutation wheels which change the alignment of intersecting keys and slots for different combinations of positions of the combination lock wheels.

Many briefcase and suitcase type combination locks utilize a hasp locking member which is hinged to the outside of the case and swings a spring loaded hinges hasp having an opening of some type attached to the end into an opening in the locking mechanism where the latch bolt engages the opening to lock the case. The present combination lock mechanism works on this principle of having a spring loaded hasp that swing into an opening which is then grasped by a latch bolt. In addition, the present invention has an easily resettable combination as well as a provision to prevent the viewing by unauthorized persons of the combination once the lock is opened.

One prior art Herriott U.S. Pat. No. 4,287,734, teaches a combination lock mechanism having indicating wheels for the combination lock which are normally viewed through windows in the lock housing and which windows are displaced from alignment with the wheels when the lock is released so that the wheels and indicia are obscured so that the combination to the lock which has been set for release cannot be observed by other parties. In the Bako U.S. Pat. No. 4,356,712, a hardware assembly for luggage provides a latching mechanism having a combination lock therein. In the Wildrick U.S. Pat. No. 1,604,866, a combination lock is provided having a plurality of permutation wheels for changing the locking combination.

The present invention is directed towards a combination lock mechanism which will rotate the combination or indicia wheels under a spring force to a zero position when the combination has been set to open the lock and this is accomplished in a lock which allows for the easy changing of the combination and allows the flexibility of not releasing the combination wheels unless desired by the user.

SUMMARY OF THE INVENTION

A combination lock mechanism for briefcases, suitcases, and the like, allows the combination wheels to be rotated to a predetermined combination to unlock the lock and to thereupon return the combination wheels back to a zero setting so that the lock combination cannot be observed once the case is opened. The lock mechanism includes a housing having a latch bolt slidably mounted in the housing for sliding between locked and unlocked positions. A latch retractor button moves a latch retractor member to move the latch bolt and the latch retractor member for moving the latch bolt between locked and unlocked positions. A plurality of spring loaded combination wheels, each having indicia thereon to indicate combination positions, are rotatably mounted in the housing. A combination wheel release button and wheel release assembly is movably connected in the housing and coupled to each of the spring loaded combination wheels for releasing the wheels from the combination position by a spring returning each combination wheel to a zero position. Permutation wheels are positioned inside of each combination wheel and locked to the combination wheel with teeth sliding into one of a plurality of internal gear teeth in the combination wheel for setting the combination position for each combination wheel. Each permutation wheel has a slot therein for receiving a key member on the latch retractor member when the combination is set in the proper position. The latch retractor button has an opening therethrough with a wheel release button mounted therethrough so that the two buttons can work together or separately. If the latch retractor button is moved, it will move the wheel release button but the wheel release button can be moved separately. Both buttons are spring loaded to return to the locking position.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figure 1:
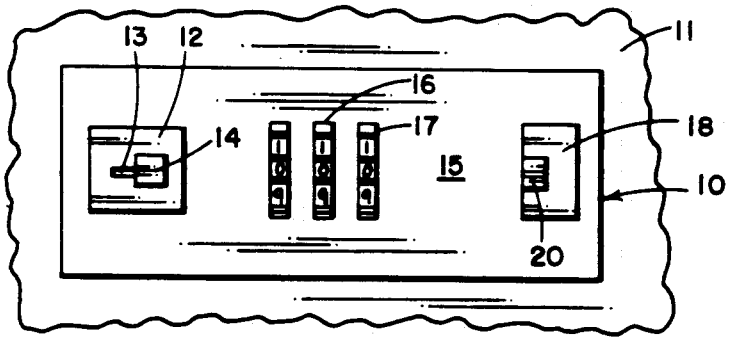
FIG. 1 is a top plan view of a combination lock mechanism in accordance with the present invention.

Referring to the drawings and especially to FIG. 1, a combination lock mechanism 10 is shown attached to a briefcase 11 and having a latch retractor button 12 on the top thereof having an elongated slot 13 therein with a wheel release button 14 mounted through the slot 13 for sliding on top of the button 12. The lock 10 has a lock mechanism housing 15 having three combination or indicia wheels 16 protruding through three windows 17. The housing 15 also has an opening 18 therein for receiving an end of a hasp-type lock and has a latch bolt 20 protruding into the opening 18. A hinge hasp (not shown), which may be spring loaded, swings one end into the opening 18 for locking with the latch bolt 20 to thereby lock the case 11. The hasp lock is placed on the opposite side of the case 11 from the lock mechanism 10. In operation, the lock mechanism, as shown in FIG. 1, will have the hasp lock locked with the latch bolt 20 until the appropriate combination of the wheel 16 is turned from the zero position, as shown in FIG. 1, to the appropriate combination for releasing the bolt 20. Once the combination is set, the latch retractor 12 is slid to the left to pull the latch bolt 20 backwards to unlock the case. Moving the latch bolt 12 moves the wheel retractor button underneath and pulls it to then release the combination wheels 16 to return to the zero position. Alternatively, the wheel release 14 can be moved at any time relative to the latch retractor button 12 to return the combination wheels 16 to the zero position. Thus, when someone opens the lock by turning the combination wheel 17 to release the bolt 20, the wheels can be returned by simply moving the wheel release 14 or, alternatively, sliding the latch retractor 12 to slide the wheel release 14 to release the combination wheels 16 and have them return to zero where no one can see the specific combination for the lock 10.

Turning to FIGS. 2–6, sectional views of the lock mechanism 10 are shown in different positions during locking and unlocking of the combination lock mechanism. The locking mechanism 10 having the housing 15 has a latch bolt 20 supported on the end of the latch retractor member 21 which is partially supported in a supporting arm 22 attached to the housing 15. A latch bolt return spring 23 is coiled around the latch retractor 21 and compressed between the arm 22 and a back portion 24 of the latch bolt 20 also supported around the latch retractor member 21. Latch retractor member 21 has a head 25 holding the retractor bolt 20 thereon against the pressure from the coil spring 23. The other end of the latch retractor member 21 is pinned with a pin 26 to the latch retractor button 12 so that movement of the latch retractor button 12 will move the latch retractor 21 and the bolt 20 against the coil spring 23. Each combination wheel 16 has a coiled spring 27 attached thereto (and to the housing 15) which coil spring is compressed upon turning the combination wheels 16 from the zero position to any other indicia position. Each spring 27 returns a wheel 16 to the zero position when released.

Each combination wheel 16 has a permutation wheel 28 removably attached therein, and each having a single key slot 30. The latch retractor member 21 has a plurality of dogs or keys 29 protruding therefrom which exactly matches the key slot 30 in each permutation wheel 28. The latch retractor member 21 is shown with three keys 29 which are each directly in front of a permutation wheel 28 so that the latch retractor member 21 cannot be retracted by moving the button 12 until all of the slots 30 in the three permutation wheels 28 are aligned by rotating the combination wheels 16 to the combination set on the permutation wheels 28. Any other combination will not align the three slots 30 and will not allow the latch retractor member 21 to be retracted to retract the latch bolt 20.

Figure 5:
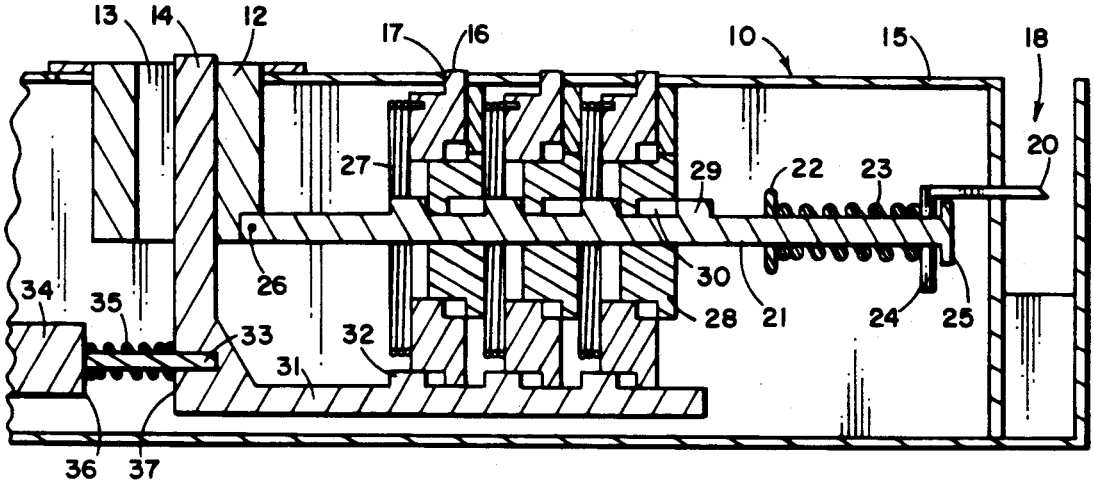
FIG. 5 is a sectional view of the combination lock of FIGS. 1-4 in a combination changing position.
Figure 8:
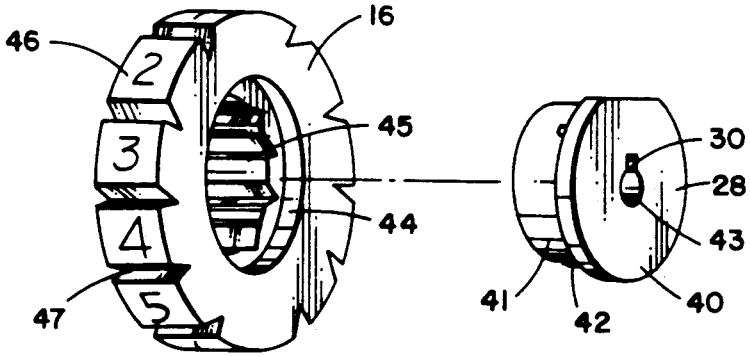
FIG. 8 is an exploded respective of the wheel assembly.

The combination can be changed in the lock mechanism by sliding the permutation wheels 28 away from their respective combination wheel 16, as shown in FIG. 5, rotating each one to a different selected combination and then sliding it back into place within the combination wheel 16. The permutation wheels 28 each have a plurality of teeth which mesh with a plurality of internal gear teeth inside the combination wheels 16 in any of the desired positions of the combination wheel 16, as seen in FIG. 8.

Figure 6:
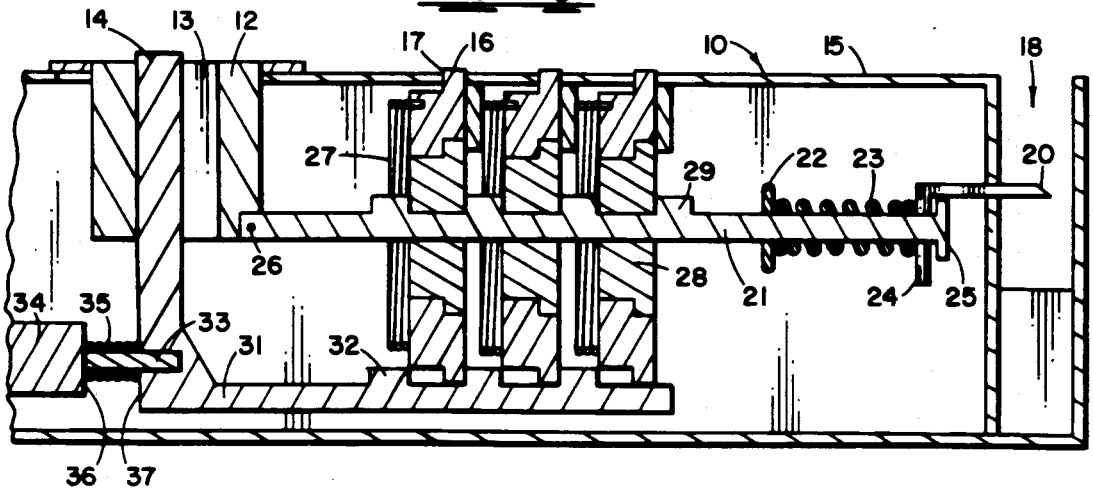
FIG. 6 is a sectional view of a lock mechanism of FIGS. 1-5 of a wheel release retracted position.

The wheel retractor button 14 can be seen extending through the passageway 13 of the button 12 and connected to the wheel release assembly 31. A horizontally extending portion of the assembly 31 has a plurality of combination wheel stops or pawls 32 thereon which are positioned to hold the combination wheels 16 against the wound up coil springs 27 when they are moved to a combination position. The combination wheels 16 are formed with notches to act as a rachet with the flexible pawls 32. The wheel release assembly 31 is supported on a wheel release assembly guide 33 which slides in a journal member 34 and has a coil spring 35 wrapped around the guide 33 between the end 36 of the journal 34 and the end 37 of the wheel release assembly 31. The wheel release assembly guide 33, wheel release assembly 31 and return spring 35 are mounted such that retracting the wheel release button 14 by either pulling the latch retraction button 12 against the button 14 to retract both or by retracting the wheel release button 14 within the slot 13 of the button 12 will slide the wheel release assembly 31 to a retracted position and when completely retracted, as shown in FIG. 6, will release the combination wheel 16 to return to their zero position by the coil springs 27.

Figure 2:
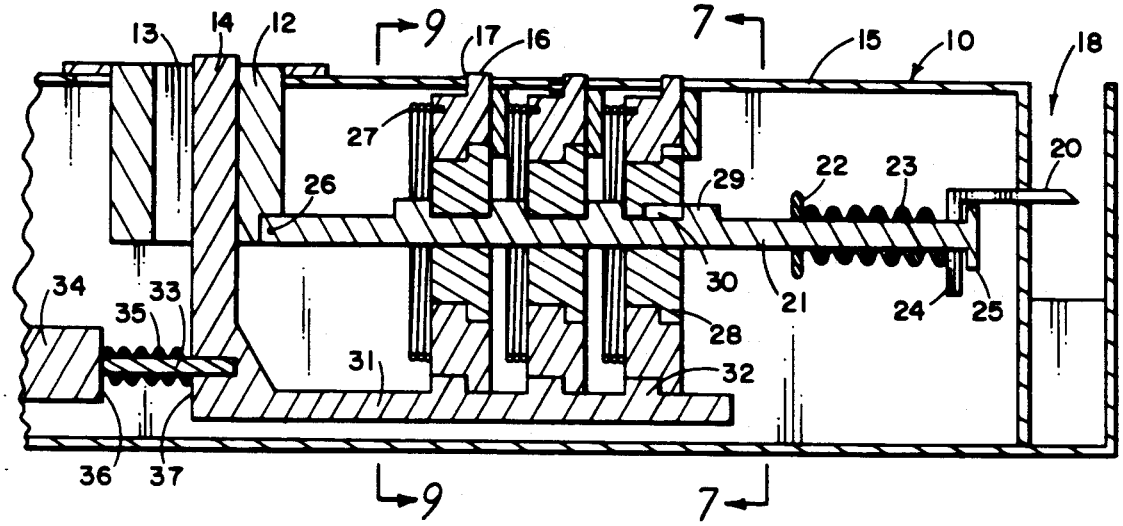
FIG. 2 is a sectional view of the lock mechanism of FIG. 1 in a locked position.
Figure 3:
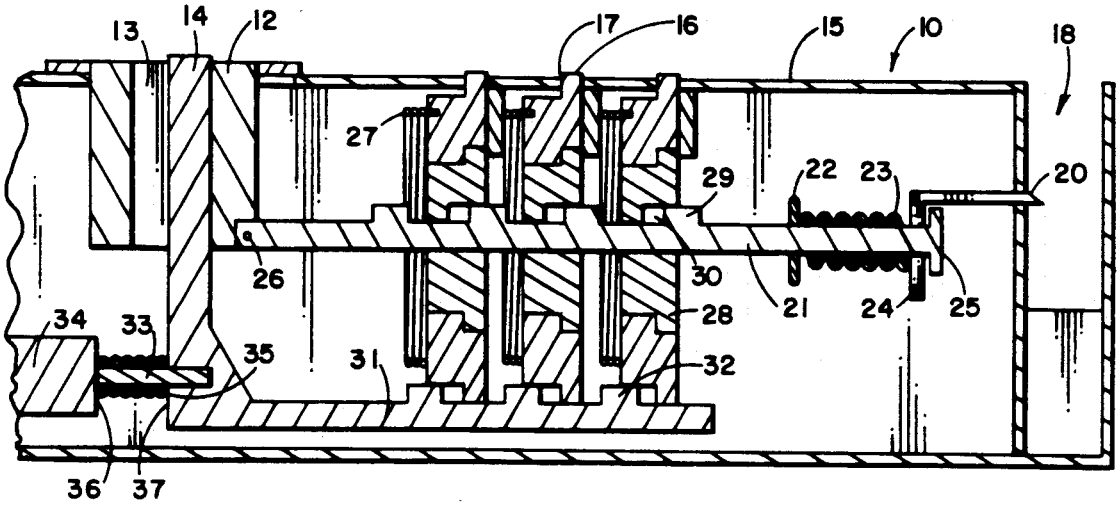
FIG. 3 is a sectional view of a lock mechanism of FIGS. 1 and 2 in a retracted position.

FIG. 2 shows the lock mechanism in a locked position with the latch bolt 20 protruding into the opening 18 where it can engage the end of a hinged hasp on the outside of the case and the wheel release assembly 31 in a zero position. FIG. 3 shows the lock mechanism 10 in a latch retracted position with the latch retractor member 21 retracted by pulling the latch retractor button 12 back to withdraw the latch retractor member 21 and to pull the latch bolt 20 to an unlatched position and which has simultaneously pulled the wheel release button 14 to a retracted position along with the assembly 31 against the coil spring 35.

Figure 4:
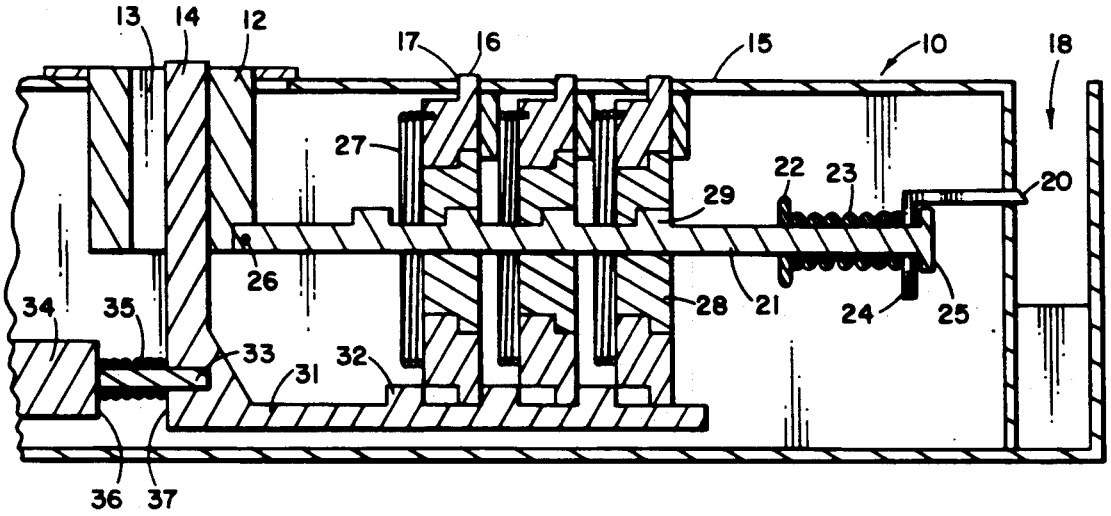
FIG. 4 is a sectional view of a lock mechanism of FIGS. 1-3 in a latch retracted and wheel released position.

FIG. 4 has the lock mechanism 10 and the latch retractor member 21 and the wheel release assembly 31 in a fully retracted position. FIG. 5 shows the locking mechanism 10 in its combination changing position with the three permutation wheels 28 slid back from the perspective combination wheel 16 where they can be rotated for a new combination. FIG. 6 shows the lock mechanism 10 with the wheel release assembly 31 retracted for returning the combination wheels 16 to the zero position without retracting the latch bolt 20.

Figure 7:
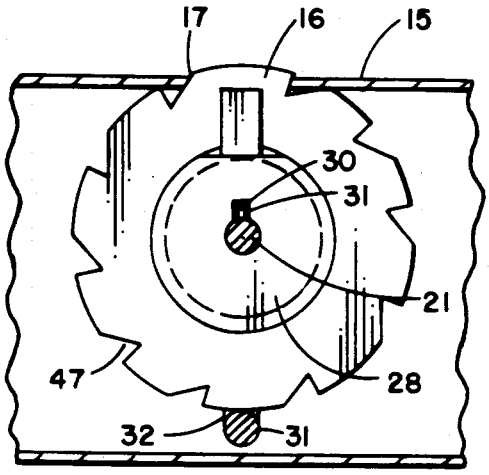
FIG. 7 is a sectional view taken on the line 7—7 of FIG. 2.
Figure 9:
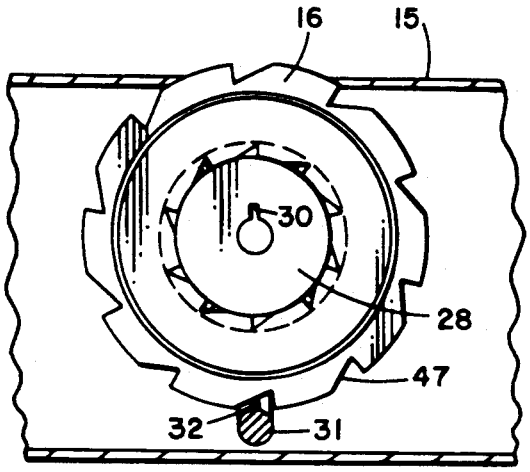
FIG. 9 is a sectional view taken on the line 9—9 of FIG. 2.

Referring to FIGS. 7, 8 and 9, the operation of the combination wheels 16 is illustrated having the permutation wheels 28 therein. The combination wheels 16 are shown mounted in the housing 15 in FIGS. 7 and 9 and having the permutation wheel 28 having a flange portion 40 and a cylindrical portion 41 and having a plurality of teeth 42 thereon and an opening 43 therethrough. The opening 43 has the key slot 30 adjacent thereto. Permutation wheel 28 fits within the combination wheel 16 opening 44 with the teeth 42 meshing with the internal gear teeth 45 on the combination wheel 16 in any of the geared positions desired to set the combination for the slot 30 to align with the predetermined combination indicia 46 on the outer surface of the wheel 16. Also seen in these views are a plurality of angled notches 47 spacing each indicia position 46 which notches are used in connection with the wheel release assembly member 31 and wheel holding pawl 32 to lock the wheels 16 in place. The pawl 32 has flexibility and work in conjunction with the shaped notches 47 to operate in the nature of a rachet and pawl mechanism to allow the combination wheel 16 to be rotated in one direction but to allow the pawl member 32 to engage the notch 47 from turning back in the other direction under the pressure of the coil springs 27. Sliding the pawl members 32 out of the way of the combination wheel 16 then allows the combination wheel 16 to return to the zero position under pressure of the coil springs 27. As seen in FIG. 7, the opening 43 of the permutation wheel 28 has the latch retractor member 21 extending therethrough with the key portion 29 slid thereinto.

It should be clear at this time that the combination lock mechanism for briefcases, suitcases, and the like has been provided which allows combination wheels to be returned to a zero position once the lock is unlocked to open the case. It should also be clear that the combination wheels can be held in the wrong position or combination and then released so that the combination cannot be viewed after opening the lock, as is the case in most combination locks which leave the combination wheels on the combination once they are opened for anyone to view at the same or later time. However, the present invention is not to be construed as limited to the forms shown which are to be considered illustrative rather than restrictive.

I claim:

1. A combination lock mechanism for brief cases and suit cases comprising::

a housing;

a latch bolt slidably mounted in said housing for sliding between locked and unlocked positions;

a latch retractor button;

a latch retractor member connected between said latch bolt and said latch retractor button for moving said latch bolt between a locked and an unlocked position responsive to sliding said latch retractor member;

a plurality of spring loaded combination wheels each having indicia thereon to indicate combination positions and each being rotatably mounted in said housing for rotation between a plurality of positions;

a combination wheel release button;

a wheel release assembly slidably connected to said housing and coupled to each of said plurality of said spring loaded combination wheels for releasing said wheels from a combination position whereby said combination wheels will rotate under spring force to a zero position where the combination cannot be viewed after opening the lock; and said wheel release assembly having said wheel release button slidably mounted through said latch retractor button whereby said latch retractor button and said wheel release button can slide separately.

2. A combination lock mechanism for brief cases and suit cases in accordance with claim 1 including a plurality of permutation wheels, one permutation wheel for each combination wheel being positioned adjacent each combination wheel for movement with the combination wheel.

3. A combination lock mechanism for brief cases, and suit cases in accordance with claim 2 in which said latch retractor member has a plurality of key protrusions thereon to engage matching openings in said permutation wheels only when the correct combination is dialed for all combination wheels and permutation wheels.

4. A combination lock mechanism for brief cases, and suit cases and the like in accordance with claim 3 including having each permutation wheel mounted partly inside one combination wheel and engaged each combination wheel with at least one tooth.

5. A combination lock mechanism for brief cases and suit cases in accordance with claim 4 in which said wheel release assembly has a spring loaded wheel release slide having a plurality of pawls engaging a plurality of ratchet teeth formed on each said combination wheel.

6. A combination lock mechanism for brief cases and suit cases in accordance with claim 5 in which said latch retractor button has a slot formed therein and said wheel release button is mounted therethrough such that movement of said latch retractor button will also move said wheel release button but said wheel release button can be moved separate from said latch retractor button within said latch retractor button slot.

7. A combination lock mechanism for brief cases and suit cases in accordance with claim 6 in which said latch retractor member has a retractor coil spring biasing said latch bolt to a locked position.

8. A combination lock mechanism for brief cases and suit cases in accordance with claim 7 in which said spring is coiled said latch retractor member around.

9. A combination lock mechanism for brief cases and suit cases in accordance with claim 8 in which each said combination wheel has a plurality of ratchet teeth having indicia therebetween.

10. A combination lock mechanism for brief cases and suit cases in accordance with claim 9 in which said wheel release assembly has a pawl member thereon aligned to engage a ratchet tooth on said combination wheel to hold each combination wheel in position when turned to a selected indicia position.

11. A combination lock mechanism for brief cases and suit cases in accordance with claim 10 in which said housing has windows wherein the indicia on each combination wheel can be seen through the housing.

12. A combination lock mechanism for brief cases and suit cases in accordance with claim 11 in which each of said permutation wheels is movable within one combination wheel to engage one permutation wheel tooth with one internal notch in said combination wheel to thereby set the lock combination.

13. A combination lock mechanism for brief cases and suit cases in accordance with claim 12 in which said key protrusions are square teeth formed on said latch retractor member.

14. A combination lock mechanism for brief cases and suit cases in accordance with claim 13 in which said pawl on said wheel release assembly is a flexible ridge.

15. A combination lock mechanism for brief cases and suit cases in accordance with claim 14 in which said spring is mounted around said latch retractor member between said latch bolt and a latch retractor support member.

16. A combination lock mechanism for brief cases and suit cases in accordance with claim 15 in which said latch retractor button has a slotted passageway therethrough and said wheel release button has a shank extending through said latch retractor button slotted passageway to slide therein.

* * * * *